US005205495A

United States Patent [19]

Garnier

[11] Patent Number: 5,205,495

[45] Date of Patent: Apr. 27, 1993

[54] APPARATUS FOR SHREDDING AND PACKAGING HAZARDOUS WASTE CONTAINERS AND THE CONTENTS THEREOF

[75] Inventor: Thomas J. Garnier, Portland, Oreg.

[73] Assignee: Shredding Systems, Inc., Wilsonville, Oreg.

[21] Appl. No.: 835,826

[22] Filed: Feb. 18, 1992

[51] Int. Cl.[5] ..... B02C 19/00

[52] U.S. Cl. ..... 241/31; 241/34; 241/159; 241/DIG. 14; 241/DIG. 38; 53/121

[58] Field of Search ..... 241/DIG. 38, 159, DIG. 14, 241/34, 31, 222, 224; 53/121, 503, 502, 284.5

[56] References Cited

U.S. PATENT DOCUMENTS

| | | | |
|---|---|---|---|
| 3,226,042 | 12/1965 | Adamski et al. | 241/222 X |
| 3,557,685 | 1/1971 | Schroering | 53/121 X |
| 4,735,368 | 4/1988 | Janko et al. | 241/DIG. 38 X |
| 4,804,024 | 2/1989 | Arhemann | 53/284.5 |
| 4,813,614 | 3/1989 | Moore et al. | 341/DIG. 31 X |
| 5,022,328 | 6/1991 | Robertson | 241/DIG. 14 X |

*Primary Examiner*—Mark Rosenbaum
*Assistant Examiner*—Frances Chin
*Attorney, Agent, or Firm*—Chernoff, Vilhauer, McClung & Stenzel

[57] ABSTRACT

An apparatus shreds hazardous waste drums and their contents in an oxygen-limited environment, transports the shredded material to a dispenser that dispenses metered amounts of the material into fire pails. The apparatus has two vertically separated shredders that are located in an enclosed shell that has an inert gas fed into it in a controlled manner by a purge system. A lift in an enclosed shaft raises the drums, two at a time, and deposits them into an airlock from which they are released one at a time into the upper shredder. A control system automatically processes the material through the apparatus from when the containers are placed into the lift until the material reaches the dispenser and insures that no stage of the process will commence until the proceeding and following stages are completed. The control system also provides safety checks at each stage to prevent handling or processing accidents.

4 Claims, 3 Drawing Sheets

APPARATUS FOR SHREDDING AND PACKAGING HAZARDOUS WASTE CONTAINERS AND THE CONTENTS THEREOF

BACKGROUND OF THE INVENTION

This invention relates to an apparatus which semiautomatically shreds hazardous waste containers and the material contained in them and places the shredded material in disposable containers in a fail-safe manner.

Hazardous waste is typically collected at industrial facilities in 55 or 85 gallon drums or other similarly sized large containers. If this waste is to be disposed of by burning in an industrial furnace, it must first be removed from the large container and placed into smaller burnable containers, such as fuel pails, which typically hold six gallons. The contaminated drums must then be disposed of, which typically is accomplished by reducing them to small pieces in counter rotating, intermeshing blade shredders and burning the shredded pieces along with the fuel pails.

This process has several shortcomings. Transferring the hazardous material from the drums to the fire pails is not only labor intensive, but it exposes the transfer personnel to the hazardous material and its fumes. In addition, a certain amount of spillage will occur which requires cleanup and may necessitate discontinuing operations until the cleanup is completed. Also, shredding the empty drums can create sparks which may ignite the hazardous material fumes and cause rapid combustion or an explosion resulting in extensive damage.

The subject invention provides an apparatus for shredding hazardous waste drums and their contents in an enclosure with a reduced oxygen concentration, having the necessary equipment to semiautomatically handle the drums, feed them into the shredder, handle the shredded material and feed measured amounts of the shredded material into fire pails. This is accomplished in an integrated apparatus having a safety check system which prevents operation of any stage of the apparatus when the previous and subsequent stages are not yet completed. The apparatus includes two vertically arrayed shredders located in a shell with the output of the first shredder dropping directly into the second shredder. A lift raises two side-by-side drums to the top of a vertical shaft located next to the shredder shell. An ejection ram pushes the drums off of the lift into an airlock located between the shaft and the shell. The barrels are dropped from the airlock into the first shredder.

The shredded material from the second shredder drops into a collection tube containing a powered auger which transfers the material to a dispenser. The dispenser dispenses metered amounts of the material into the fire pails.

In an alternate embodiment the collection tube carries two parallel, side-by-side augers that are individually operable in either direction. This embodiment permits mixing multi-component waste into a homogeneous blend before it dispensed into the pails.

A purge system feeds inert gas into the apparatus and maintains the oxygen concentration between preset limits. In a preferred embodiment, if the oxygen concentration exceeds these limits, the apparatus is shut down and an alarm sounded.

A control system automatically processes material through the apparatus from when the drums are loaded onto the lift until the shredded material is ready to be discharged from the dispenser. The control system has built-in safeguards which ensure that the apparatus is ready for each stage of the process before that stage is allowed to occur in order to prevent accidents.

Accordingly, it is a principal object of the subject invention to provide an apparatus that semiautomatically loads hazardous waste drums into a shredder, shreds the drums and the material carried in them and feeds the shredded material to a dispenser which dispenses metered amounts of this material into disposable containers.

It is a further object of the subject invention to provide such an apparatus that provides a low oxygen environment for this operation.

It is a further object of the subject invention to provide such an apparatus having a control system that sequentially processes the drums through the apparatus one at a time.

It is a still further object of the subject invention to provide such an apparatus having a safety system that prevents any stage of the process from occurring unless the previous and subsequent stages have been completed and the apparatus is in the proper configuration for the next stage.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
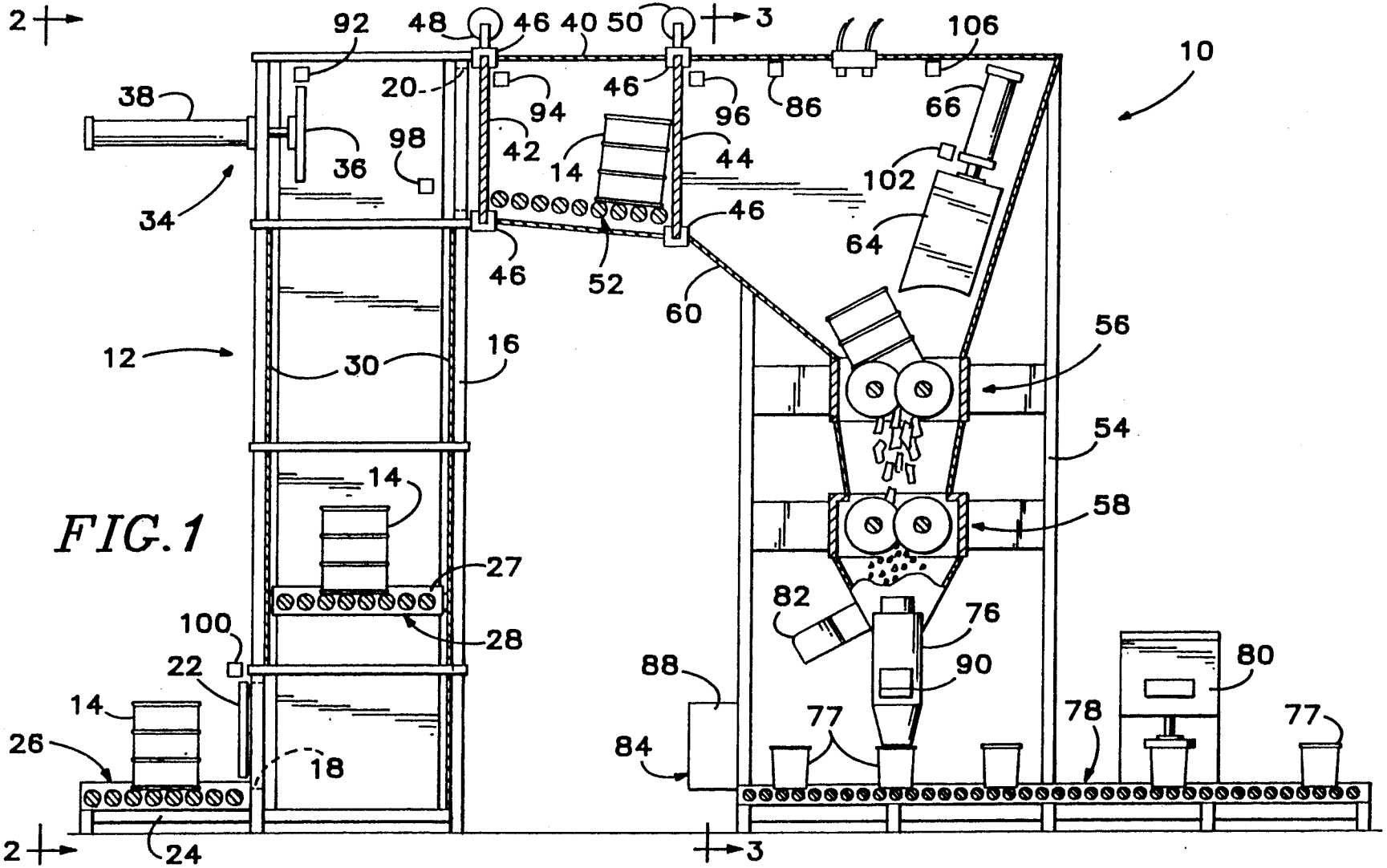
FIG. 1 is a side elevation view, in cross-section, of a hazardous waste shredding apparatus embodying the features of the subject invention.
Figure 3:
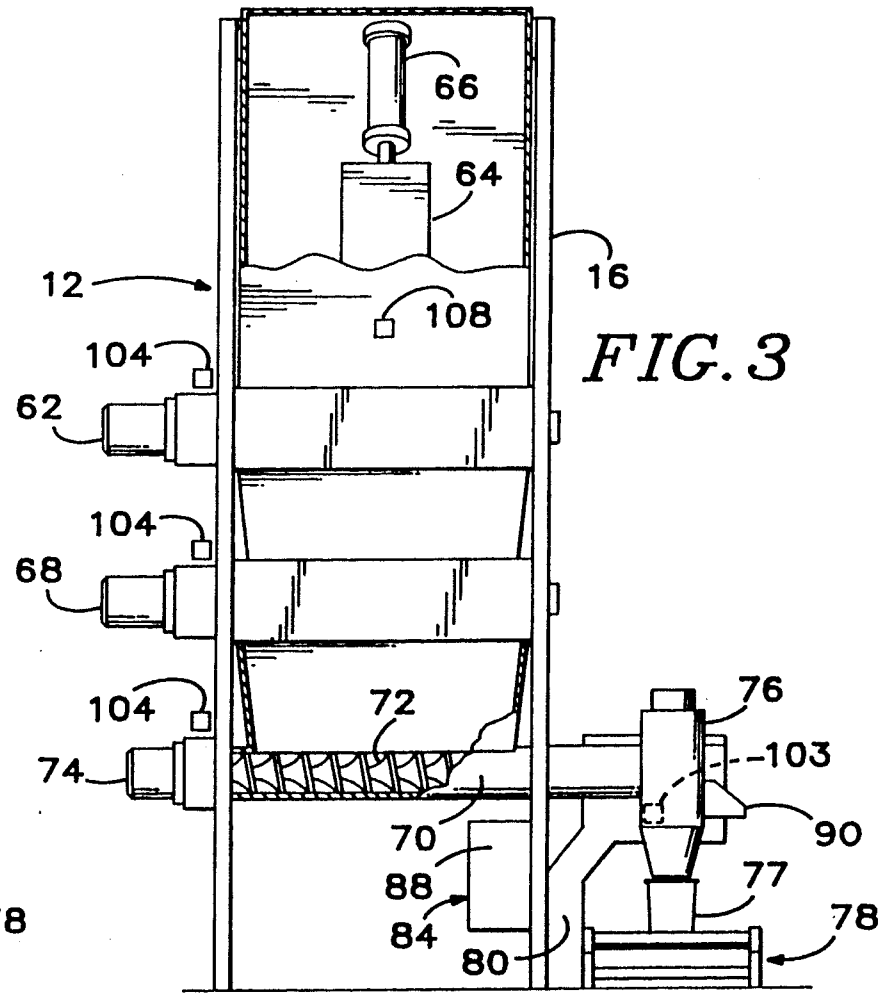
FIG. 3 is a sectional view taken along the line 3—3 of FIG. 1.
Figure 2:
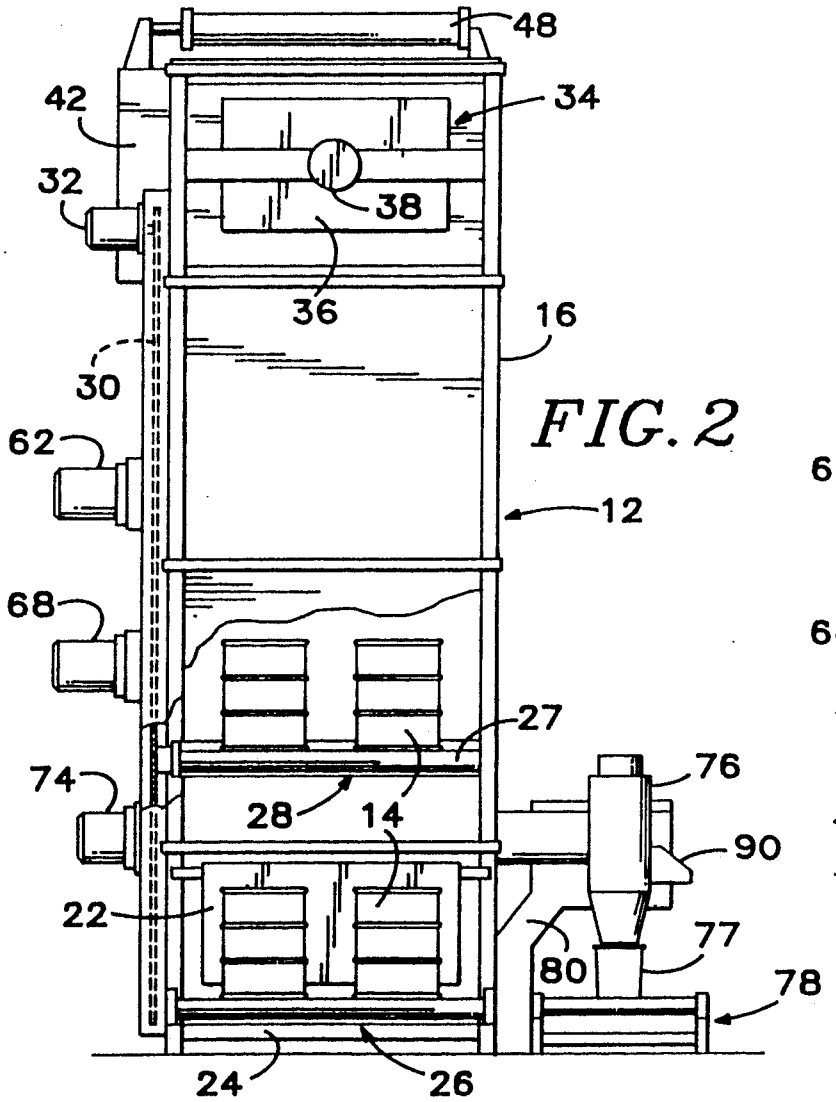
FIG. 2 is a side elevation view taken on the line 2—2 of FIG. 1.

Referring now to the drawings, a shredding apparatus 10 includes a lift 12 which raises two 55 gallon or one 85 gallon hazardous waste drums 14, or other similarly sized containers, to the top of the apparatus. The lift includes an enclosed vertical shaft 16 having an intake opening 18 at its bottom and an outlet opening 20 at its top. The intake opening 18 is covered by a door 22, and a platform 24, having a freely rotatable roller conveyor 26 located on it, is located adjacent to the door. A lift platform 27, also having a freely rotatable roller conveyor 28 located on it, is movable through the shaft by means of a chain drive 30 and motor 32. An ejection system 34 pushes the drums off of the lift platform when the platform is at the top of the shaft. The ejection system includes a ram 36 that is operated by a hydraulic piston cylinder 38. The ram is shaped to confine either single drums, misshapen drums or odd sized containers. When the ram is operated the shape of the ram tends to keep the material in the center of the ram thereby ensuring that the operation of the system proceeds automatically.

The opening 20 at the top of the shaft 16 communicates with an airlock 40. An infeed door 42 encloses the end of the airlock that is attached to the lift shaft, and an discharge door 44 encloses its other end. The infeed and discharge doors slide horizontally in tracks 46 and are operated by hydraulic piston cylinders 48 and 50 respectively. A roller type conveyor 52, located on the floor of the airlock, slopes to automatically transport drums through the airlock.

The discharge side of the airlock 40 is connected to an enclosed shell 54 containing a first shredder 56 that is capable of rough shredding the drums, and a second shredder 58 that is capable of reducing material from the first shredder into uniformly sized pieces, preferably approximately 2-inch squares or cubes. The first shredder is located below the airlock discharge and is connected to it through a hopper 60. The first shredder is powered by a hydraulic motor 62. A hopper ram 64 located above the first shredder is activated by a hydraulic piston cylinder 66 to assist in feeding material into the first shredder. The second shredder 58 is located immediately below the first shredder 56 and material exiting the first shredder drops into the second shredder. The second shredder is operated by a hydraulic motor 68. The first and second shredders 56 and 58 and the ram 64 utilize designs that are well known in the industry. Preferably, the first shredder has an autochop feature to aid in the reduction of material, to assist in metering of the material and to provide a degree of control of the particle size. Both shredders have the capability to detect a jam condition and automatically reverse direction to clear the jam and then resume normal operation.

Located below the second shredder 58 is a collection conduit 70 that receives shredded material from the second shredder and dispenses it into a disposable container, such as a fuel pail 77. An auger 72 located in the collection conduit is powered by a hydraulic motor 74 to transport the material to a dispenser 76 that is located beside the shell 54. The auger also has the capability to detect a jam and automatically reverse direction to clear the jam and then reverse. The dispenser, which is commercially available, is semiautomatic. The operator places each fuel pail 77 under the dispenser and activates the apparatus. The dispenser then dispenses a metered amount of the shredded material into the pail. The dispenser can be adjusted to dispense different amounts of material. The dispenser can also be operated to continuously fill a container as long as the operator of the dispenser desires. A roller conveyor 78 facilitates placing the pails under the dispenser and a lid crimper 80 affixes a lid placed on each pail by the operator after it is filled. An auger bypass 82 allows shredded material 58 to be diverted from the collection duct 70, if necessary.

Figure 4:
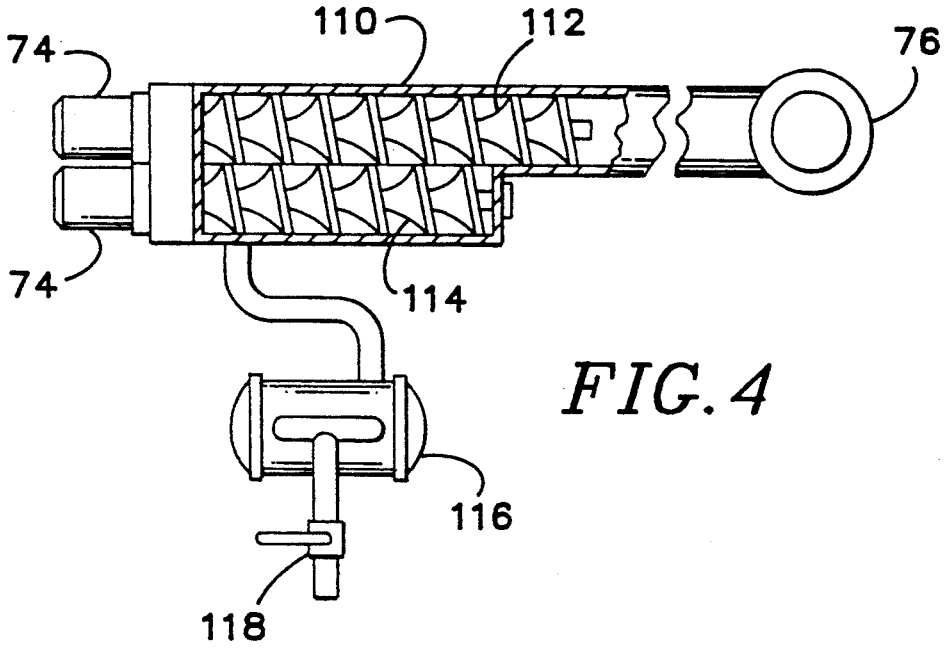
FIG. 4 is a plan view, partially broken away, of an alternate embodiment of the auger discharge system of the invention.

In an alternate embodiment of the invention shown in FIG. 4, the collection conduit 110 is arranged to carry two parallel, side-by-side augers. A first auger 112 is similar to the auger 72 in the single auger system and extends to the dispenser 76. A second auger 114 is shorter than the first auger. The augers 112, 114 are driven by separate hydraulic motors 74 and each motor can independently be operated in either a clockwise or counterclockwise direction at variable speeds. A two-direction hydraulically driven pump 116 is connected to the bottom of the collecting conduit 110 and is operable by appropriate controls and a valve 118 to pump fluid material into and out of the collection conduit. While the pump 116 is shown in the drawings only in conjunction with the dual auger system it can be used with the single auger system as well.

The apparatus includes a purge system, shown schematically at 84, that introduces inert gas into the shell and removes air and processes it in an appropriate manner. The purge system includes a series of sensors, shown schematically at 86, which are located at several strategic locations in the shell to monitor the oxygen concentration in the shell. The sensors feed data to a purge control, shown schematically at 88, that operates the purge system. The purge control permits the user to select three set points. Inert gas is introduced into the shell when the oxygen concentration exceeds the level called for by the first set point. The flow of inert gas into the shell is discontinued when the oxygen concentration drops below the level called for by the second set point. When the oxygen concentration in the shell exceeds the level called for by the third set point, operation of the shredders 56 and 58 and other portions of the system will be discontinued and an alarm system (not shown) will be activated.

The apparatus is operated by a control system, shown schematically at 90. The control system includes an ejection ram sensor 92 that senses whether the ejection ram 36 is retracted or extended, an airlock infeed door sensor 94 and an airlock discharge door sensor 96, that sense whether the respective airlock doors 42 and 44 are open or closed, a lift position sensor 98, that senses whether the lift platform is at the top of the shaft 16, a door sensor 100, that senses whether the door 22 is open or closed, a ram sensor 102, that senses whether the ram 64 is extended or retracted, and a dispenser sensor 103, that indicates whether the dispenser 76 is jammed. In addition, the shredders and the auger all have sensors 104 that measure the load on their respective drive motor and indicate when either a jam or no-load condition occurs.

The various sensors and operator controls operate through a microprocessor to control the operation of the apparatus, as will be more fully explained later. In addition to operating the apparatus in its normal sequence, the control system provides a safety check which prevents operation of a particular operational sequence or the entire apparatus when it would be unsafe to do so. The safety system will not allow operation of the purge system if any access door is open at an inappropriate time. The lift 28 can only raise drums to the top of the shaft 16 when the ram 36 is retracted. The ram 36 can only extend to push drums into the airlock 40 when the lift is at the top of the shaft, the airlock infeed door 42 is open, the airlock discharge door 44 is closed, and the airlock discharge door has cycled since the last extension of the ram. The airlock discharge door 44 cannot open unless the first shredder 56 is operating, the airlock infeed door 42 is closed, the hopper ram 64 is retracted and the sensor 104 on the first shredder indicates that no material is being shredded. The first shredder 56 cannot operate if the second shredder 58 is jammed. The second shredder cannot operate if the auger hopper is full or the auger is jammed. The auger cannot operate if the dispenser is jammed or full. The entire system cannot operate unless the purge system is functional and operating. Finally, the system will not operate or if operating will stop if any access door is open.

The apparatus also includes a fire suppression system. Heat sensors, shown schematically at 106, indicate the temperature at several points in the apparatus. When any of the heat sensors exceed a predetermined level, the fire suppression system stops the apparatus and sprays a chemical fire retardant into the shell and an alarm is sounded. The fire suppressant system can also be operated manually.

Rupture panels, shown schematically at 108, are placed at strategic locations in the apparatus. The rupture panels, which are commercially available, relieve pressure in the shell in the event that rapid combustion occurs. The basic structure (shaft 16, shell 54, hopper 60, etc.) is designed to withstand a surge in pressure created by combustion until the rupture panel is ruptured.

Operation of the apparatus is partially controlled by the control system and partially controlled by operators. Operation is commenced by placing drums 14 on the conveyor 26 of the platform 24, lifting the door 22 and pushing the drums into the lift platform 28. A start switch (not shown) is pressed and, if the ram 36 is retracted, the airlock discharge door 42 is closed and there are no safety faults, the platform will raise in the shaft 16. When the lift platform reaches the top of the shaft it will contact the lift sensor 98. Assuming that the airlock infeed door is open and the airlock discharge door is closed and has completed a cycle, the piston cylinder 38 will extend the ram 36 and push the drums into the airlock where the conveyor 52 will cause them to rest against the airlock discharge door 44. Once the piston cylinder 38 is fully extended it will retract again and when it is fully retracted, the control system will close the airlock infeed door 42 and open the air-lock discharge door 44 approximately one-half way so that one drum will fall out of the airlock, slide down the hopper 60 and into the first shredder. After a fixed amount of time, the airlock discharge door will be fully opened and allow the remaining drum to drop into the first shredder. Thus the two drums drop into the first shredder one at a time. The airlock discharge door will then be closed and the airlock infeed door will be opened.

As the drums are being processed in the first shredder, the control system will cause the hydraulic cylinder 66 to periodically extend so that the ram 64 will assist in feeding the drums through the shredder. The second shredder will process the material from the first shredder, and is operated at a speed such that no appreciable amount of material will become accumulated above it. The shredded material then drops out of the second shredder and into the collection tube 70 where the auger 72 moves it to the dispenser 76. An operator will place empty fire pails under the dispenser and activate it to fill the pails. The control system will prevent activation of the dispenser if the auger is either jammed or empty.

Once the first set of drums is processed, the operation is repeated, however, the airlock discharge door will not open until the sensor 104 on the first shredder 56 indicates that shredding of a previous set of drums is completed.

Hazardous waste of the type processed in the subject invention includes a wide range of materials. Generally, when hazardous waste is used as a fuel supplement it must provide a specified amount of energy and burn at a specified rate. If its energy content is low it must be augmented, either with fuel or higher energy waste, and if its energy content is high it must be cut. Likewise, if it is overly volatile, filler material must be added and if it is too viscous it must be thinned. The material necessary to make these adjustments can easily be added to the apparatus, either directly into the hopper 60 or through the pump 116. However, if an appreciable amount of material must be mixed to give the correct thickness and heating value the dual auger shown in FIG. 4 must be utilized to provide the necessary mixing.

Mixing is accomplished by filling the collection conduit 110 with the unmixed components by rotating both augers 112, 114 counterclockwise, looking toward the dispenser 76. The first auger is then rotated in the clockwise direction and the second auger is rotated in the counterclockwise direction until the material is thoroughly mixed. The direction of both augers is then reversed to discharge the mixed material to the dispenser.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for shredding hazardous waste containers and the material carried therein and packaging the shredded material in fuel pails, comprising:

(a) an elevated airlock sized to carry at least one container;

(b) lift means for raising containers to the level of said airlock;

(c) ejection means for moving containers off of said lift means into said airlock;

(d) shredding means located below said airlock for shredding the containers;

(e) discharge means for moving containers out of said airlock and into said shredding means one container at a time;

(f) shredding means, located below said first shredding means, for receiving shredded material from said first shredding means and shredding it into uniform pieces of predetermined size;

(g) feed means for collecting the shredded material from said shredding means and feeding it out of said shell;

(h) purge means for introducing inert gas into said shell and maintaining the oxygen level in said shell below a predetermined level; and (i) dispenser means associated with said feed means for placing a metered amount of shredded material into each fuel pail.

2. The apparatus of claim 1, including pail transport means for sequentially positioning fuel pails at said dispenser means.

3. The apparatus of claim 1 wherein said feed means comprises an auger.

4. The apparatus of claim 1 wherein said feed means comprises:

(a) a pair of side-by-side augers that are mounted to rotate individually about parallel axes; and (b) means for rotating said augers about their respective axes, individually of one another in either a clockwise or counterclockwise direction.

* * * * *